US005865525A

United States Patent [19]

Kibler et al.

[11] Patent Number: 5,865,525

[45] Date of Patent: Feb. 2, 1999

[54] SLIDE FOCUS FLASHLIGHT

[75] Inventors: Gary W. Kibler, Flower Mound; Dick E. Davis, Arlington, both of Tex.

[73] Assignee: Nordic Technologies, Inc., Salt Lake City, Utah

[21] Appl. No.: 835,423

[22] Filed: Apr. 9, 1997

Related U.S. Application Data

[60] Provisional application No. 60/015,236 Apr. 10, 1996.

[51] Int. Cl. [6] ..... F21L 7/00

[52] U.S. Cl. ..... 362/187; 362/188; 362/205

[58] Field of Search ..... 362/187, 188, 362/197, 198, 202, 203, 204, 205, 206, 208

[56] References Cited

U.S. PATENT DOCUMENTS

| | | | |
|---|---|---|---|
| D. 267,514 | 1/1983 | Leung | D26/37 |
| D. 268,175 | 3/1983 | Kong | D10/114 |
| D. 308,253 | 5/1990 | Battles et al. | D26/38 |
| D. 350,618 | 9/1994 | Parker | D26/37 |
| D. 351,245 | 10/1994 | Maglica | D26/49 |
| D. 360,044 | 7/1995 | Tillery | D26/49 |
| D. 362,735 | 9/1995 | Hiromori | D26/37 |
| D. 366,338 | 1/1996 | Garrity | D26/49 |
| D. 366,708 | 1/1996 | Santarsiero | D26/43 |
| D. 366,709 | 1/1996 | Szmanski | D26/43 |
| 1,674,650 | 6/1928 | Leser . | |
| 1,778,039 | 10/1930 | Rogge . | |
| 1,958,796 | 5/1934 | Mercer . | |
| 2,125,038 | 7/1938 | Tompkins et al. | 240/10.66 |
| 2,816,215 | 12/1957 | Jarred | 240/10.6 |
| 2,832,968 | 5/1958 | Knudsen | 9/8.3 |
| 4,376,965 | 3/1983 | Bacevius | 362/191 |
| 4,398,238 | 8/1983 | Nelson . | |
| 4,432,043 | 2/1984 | Yuen | 362/184 |
| 4,443,833 | 4/1984 | Fazzina | 362/189 |
| 4,533,982 | 8/1985 | Kozar | 362/183 |
| 4,570,208 | 2/1986 | Sassmannshausen | 362/188 |
| 4,648,013 | 3/1987 | Curiel | 362/183 |
| 4,794,315 | 12/1988 | Pederson et al. | 320/2 |
| 4,823,242 | 4/1989 | Maglica et al. | 362/187 |
| 4,841,417 | 6/1989 | Maglica et al. | 362/206 |
| 4,843,526 | 6/1989 | Price, III | 362/187 |
| 4,868,724 | 9/1989 | Tung | 362/189 |
| 4,903,178 | 2/1990 | Englot et al. | 362/183 |
| 4,916,588 | 4/1990 | Chu | 362/203 |
| 4,956,755 | 9/1990 | Maglica et al. | 362/206 |
| 4,987,523 | 1/1991 | Lindabury et al. | 362/188 |
| 5,142,458 | 8/1992 | Brunson | 362/194 |
| 5,143,441 | 9/1992 | Maglica | 362/263 |
| 5,158,358 | 10/1992 | Maglica et al. | 362/206 |
| 5,171,086 | 12/1992 | Baloochi | 362/188 |
| 5,197,796 | 3/1993 | Moore | 362/202 |
| 5,239,451 | 8/1993 | Menke et al. | 362/199 |
| 5,287,255 | 2/1994 | Strodtman | 362/102 |
| 5,349,507 | 9/1994 | Parker | 362/158 |
| 5,400,227 | 3/1995 | Maglica et al. | 362/206 |
| 5,424,927 | 6/1995 | Schaller et al. | 362/157 |
| 5,461,551 | 10/1995 | Clayton | 362/183 |
| 5,461,552 | 10/1995 | Tillery | 362/188 |
| 5,485,360 | 1/1996 | Maglica | 362/158 |
| 5,560,705 | 10/1996 | Shiau | 362/188 |

OTHER PUBLICATIONS

International Search Report dated Jul. 9, 1997 for International Application No. PCT/US97/05993.

*Primary Examiner*—Stephen F. Husar
*Assistant Examiner*—Matthew J. Spark
*Attorney, Agent, or Firm*—Baker & Botts, L.L.P.

[57] ABSTRACT

A slide focus flashlight has a container with an aperture therein, a lamp disposed within the container, a reflector disposed within the container, and an actuator disposed in the opening of the container for sliding therein and having a first angled surface. A conductive shaft is disposed within the container, and a slide interface is coupled to the conductive shaft. The slide interface has a second angled surface for sliding against the first angled surface of the actuator. A power switch is provided for selectively energizing the lamp. The slide interface, actuator and power switch allow for single-handed focusing and energizing of the flashlight.

16 Claims, 2 Drawing Sheets

SLIDE FOCUS FLASHLIGHT

CROSS REFERENCE TO RELATED APPLICATIONS

This application claims priority under 35 USC § 119 of provisional application number 60/015,236 filed Apr. 10, 1996.

TECHNICAL FIELD OF THE INVENTION

This invention relates in general to flashlights and more particularly to a slide focus flashlight.

BACKGROUND OF THE INVENTION

Flashlights with a power switch and mechanisms to adjust the beam of light have been developed. For a couple examples, see the following U.S. Pat. Nos.: 5,158,358 and 4,916,588. These devices, however, have certain disadvantages. One disadvantage in many such devices is that they are awkward or impossible to turn on and focus without requiring two hands. This deficiency was recognized and some effort was made to resolve it.

U.S. Pat. No. 5,171,086 to Baloochi is an example of an effort to address some of the deficiencies. Baloochi shows a hand-held adjustable focus flashlight involving numerous parts and complexity, which typically translates into relatively high manufacturing costs and issues of reliability with all the moving parts. As another example of a complex attempt to address problems in creating a focusable flashlight for operation with one hand, some have proposed using devices with pinned cams that at the extremes operate the power switch and in intermediate positions use the cam to move the lamp relative to the reflector to focus the flashlight.

SUMMARY OF THE INVENTION

Therefore, a need has arisen for a focusable flashlight capable of operation by a single hand of the operator that is relatively easy to manufacture. According to an aspect of the present invention, a flashlight is provided having a container with an opening; a lamp for producing light when energized; a reflector for reflecting light, the reflector and the lamp disposed within the container; an actuator disposed within the opening of the container, sized and configured to slide in the container, and the actuator having a first angled surface; a shaft disposed within the container; a slide interface coupled to the shaft and having a second angled surface for siding against the first angled surface of the actuator, the slide interface for urging the shaft in a first direction as the first angled surface of the actuator delivers a force to the second angled surface of the slide interface; a power switch for selectively energizing the lamp; a spring for urging the shaft in a second direction; and the lamp or reflector associated with the shaft whereby movement of the shaft causes relative movement of the lamp and the reflector to allow focusing of light from the lamp.

According to another aspect of the present invention, a power switch may include a slide shoe for providing a positive contact to the conductive shaft, which may be associated with the positive contact of the lamp, a conductive spring for providing a negative contact to the lamp, and a collar having at least an insulated portion such that when the slide shoe is forced over the insulated portion, power is no longer provided to the lamp, but when conductive shaft is moved such that the slide shoe is in contact with the conductive shaft, power is supplied to the lamp.

According to another aspect of the present invention, a slide switch may be utilized to depress the actuator. According to yet another aspect of the present invention, detents can be added to an angled internal surface of the slide switch.

A technical advantage of the present invention is that it may be relatively easy to manufacture when compared with conventional designs.

Another technical advantage of the present invention is that it may be focused and selectively energized by a single hand of an operator.

BRIEF DESCRIPTION OF THE DRAWINGS

For a more complete understanding of the present invention and the advantages thereof, reference is now made to the following written description taken in conjunction with the accompanying drawings, in which.

DETAILED DESCRIPTION OF THE INVENTION

The preferred embodiments of the present invention and its advantages are best understood by referring to FIGS. 1–4 of the drawings, like numerals being used for like and corresponding parts of the various drawings.

Figure 1:
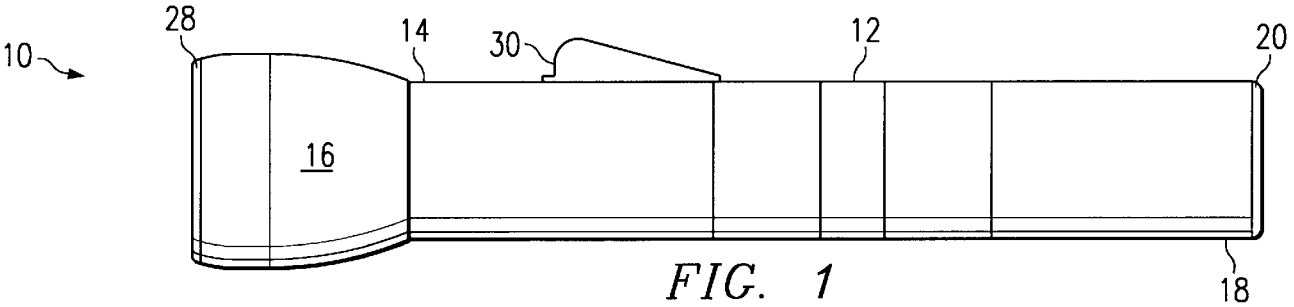
FIG. 1 is a perspective view in elevation of a flashlight according to one aspect of the present invention.
Figure 2:
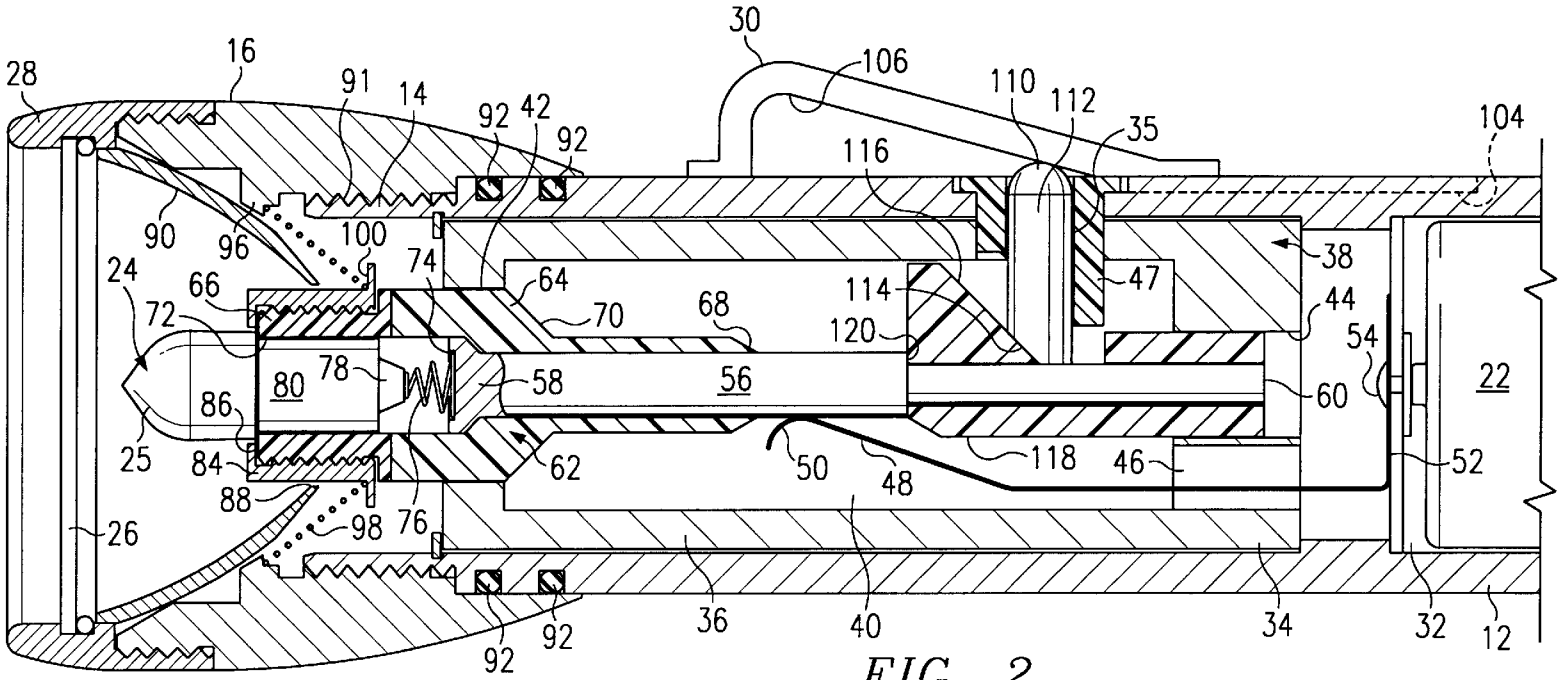
FIG. 2 is a cross sectional view of a portion of the flashlight of FIG. 1 with the switch in a first extreme position.

Referring to FIGS. 1 and 2 a flashlight 10 has a main body 12, which is part of flashlight container or body. Removably coupled to a first end 14 of body 12 is head 16. Removably coupled to a second end 18 of body 12 is an end cap 20. End cap 20 may be removed to place batteries 22 (FIG. 2) in flashlight 10. Head 16 may be removed from body 12 to allow access to lamp 24 of FIG. 2. Protecting lamp 24 is a lens 26 (FIG. 2), which may be held in place by a lens ring 28. Slidably attached to an exterior portion of body 12 is a slide switch or combination-switch-and-focus adjustor 30. Slide switch 30 is arranged to move relative to body 12.

Referring to FIG. 2, body 12 is formed with a cavity 32 formed therein. Disposed within cavity 32 and coupled to body 12 is actuator housing 34. Actuator housing 34 may be made from polypropylene, other plastics, or even metal. Actuator housing 34 has a first end 36 and a second end 38, and is formed with a cavity 40. A first aperture 42 is formed on first end 36 of actuator housing 34. A second aperture 44 is formed on second end 38 of aperture housing 34. Additionally, second end 38 of aperture housing 34 has slot 46. Cavity 32 of body 12 may also have batteries 22 disposed therein and abutting second end 38 of actuator housing 34.

A conductive slide shoe 48 may be electrically coupled to a positive contact of battery 22. Slide shoe 48 may have a first or curved portion 50 and a flat or second end 52. Flat portion 52 of slide shoe 48 may be secured to actuator housing 34 by a fastener 54. Fastener 54 also may serve to electrically couple slide shoe 48 to the positive contact of battery 22. A longitudinal, conductive shaft 56 may be disposed within cavity 32 and further disposed through cavity 40 of actuator housing 34. Shaft 56 is sized and configured to slide within first aperture 42 and second aperture 44 of actuator housing 34. Apertures 42 and 44 serve to guide shaft 56 as it slides longitudinally about or with respect to body 12. Shaft 56 has a first end 58 and a second end 60. Coupled to first end 58 of conductive shaft 56 is collar 62.

Collar 62 may have an insulated portion 64 and a conductive sleeve portion 66. Conductive sleeve 66 may be attached to insulated portion 64 of collar 62 by glue, ultrasonic welding or by any other means known in the art. The insulated portion 64 may surround first end 58 of shaft 56 and extend towards second end 60 a predetermined distance. Insulated portion 64 may have a first angled shoulder 68 and a second angled shoulder 70. Proximate the juncture of conducting sleeve 66 and insulated portion 64 of collar 62 there is formed a lamp-receiving cavity 72.

Lamp 24 is disposed within cavity 72. Also, disposed within cavity 72 or a portion of cavity 72 is a flattened, depressed portion 74 of first end 58 of shaft 56. Flattened portion 74 is designed to receive and hold an end of lamp spring 76, which is a conductive metal spring. Spring 76 electrically couples conductive shaft 56 with positive contact 78 of lamp 24. Lamp 24 also has a bulb jacket 80 and bulb 25. Bulb jacket 80 is electrically coupled with conductive sleeve 66. Once lamp 24 is placed within lamp-receiving cavity 72, it may be held in place by bulb cap 84 which depresses on bulb flange 86. Bulb cap 84 may attach to conductive sleeve 66 by mating threads as shown. Lamp 24 extends through lamp-receiving aperture 88 in reflector 90, which is preferably a parabolic reflector.

Reflector 90 rests against a portion of head 16 and may be held in place by a portion of lens ring 28. Head 16 may be removably attached to body 12 at first end 14 by mating threads 91 (internal threads on head 16 and external threads on body 12). O-rings 92 may be provided between head 16 and body 12 to seal moisture out of cavity 32. Lens 26 may be held by lens ring 28 in a secured manner and in a manner that provides a moisture barrier. Lens ring 28 is secured to head 16 in a removable fashion and it also a moisture barrier to help protect the internal components within cavity 32. Shoulder 96 on head 16 may be formed to resist or interact with conductive spring 98.

Conductive spring 98 provides a separating force between shoulder 96 and bulb cap shoulder 100. Conductive spring 98 serves at least two functions. First, it urges bulb cap 84 and the components coupled to it such as shaft 56 away from shoulder 96 and towards second end 18 of flashlight 10. Second, conductive spring 98 contributes to the negative contact of a circuit required for illumination of lamp 24. In the preferred embodiment, the lamp circuit uses body 12. Body 12 is preferably aluminum and is electrically coupled to head 16 by metal-on-metal contact of threads 91, which in turn is electrically coupled through spring 98 to bulb cap 84 which is electrically coupled to conductive sleeve 66, and thereby to bulb jacket 80. The positive electrical input for the lamp 24 is provided from positive contact of battery 22 to fastener 54 to slide shoe 48 to conductive shaft 56 to lamp spring 76 and finally to positive contact 78. Whether the circuit for lamp 24 is energized or not is determined by whether slide shoe 48 is in contact with shaft 56 as will be described further below.

Figure 3:
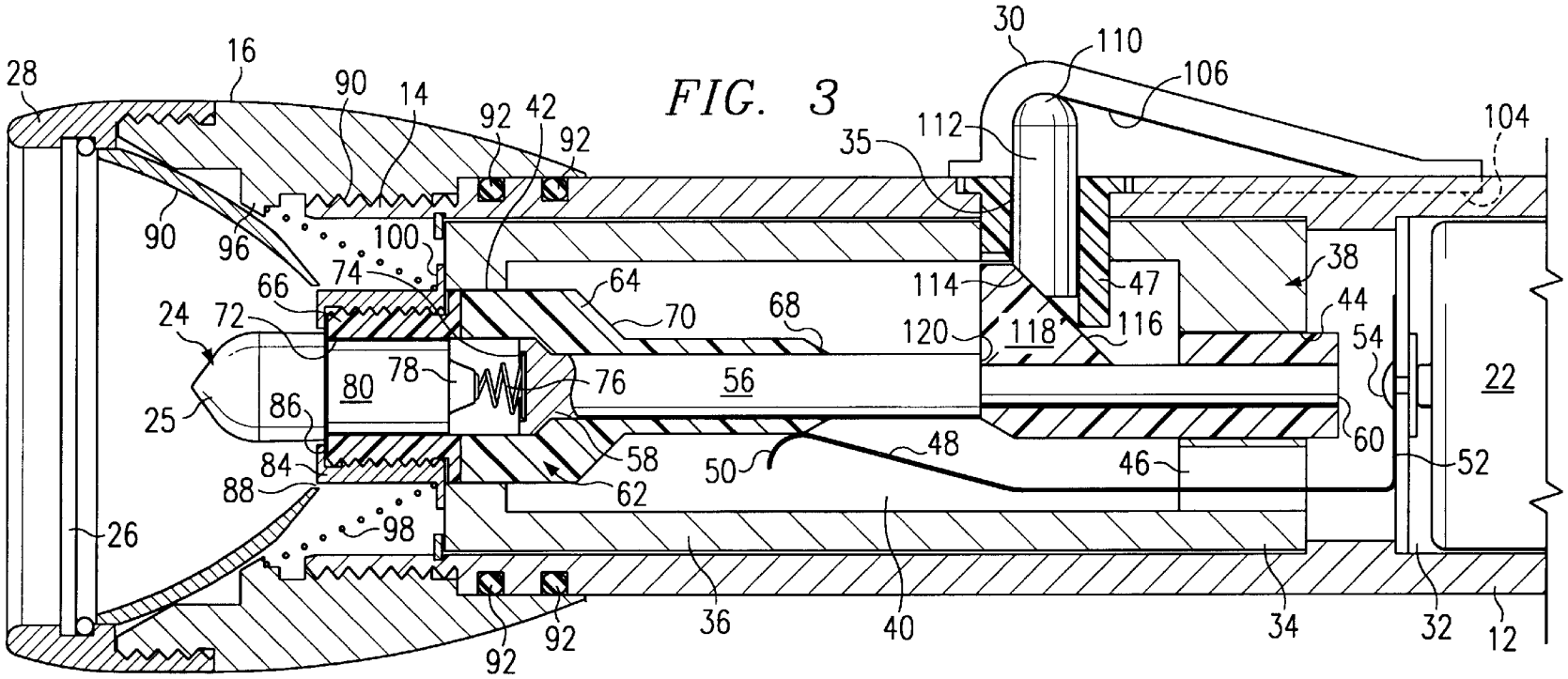
FIG. 3 is a cross sectional view of a portion of the flashlight of FIG. 1 with the switch in a second extreme position.

Body 12 of flashlight 10 has a slide switch track 104 for slidably holding slide switch 30 as it moves between a first extreme position (FIG. 2) and a second extreme position (FIG. 3). Slide switch 30 has an inner angled surface 106. Track 104 is positioned on body 12 such that slide switch 30 is disposed adjacent to and substantially over an actuator link 112. An aperture in body 12 is sized to receive a first end 110 of actuator link 112.

Actuator link 112 has a first angled surface 114, which is opposite to first end 110. First angled surface 114 is angled to complement second angled surface 116 formed on slide interface 118. Slide interface 118 is secured to a portion of conductive shaft 56. Slide interface 118 may be attached to shaft 56 by any means known in the art such as glue, ultrasonic welding, or a pin, but preferably slides on shaft 56 and is held in position as needed by shoulder 120 formed on shaft 56. Slide interface 118 is preferably manufactured from a low-coefficient-of-friction plastic to allow it to slide easily against first angled surface 114. Actuator housing 34 is formed with a third aperture 35 allowing actuator link 112 to extend therethrough. Additionally, an aperture collar 47 may be placed in the apertures in housing 34 and body 12 that receive actuator link 112 to help keep moisture out of cavity 32.

Distinct indents may be added to inner surface 106 to provide discrete holding or resting points for slide 30. As first end 110 of actuator link 112 enters the detent on surface 106, it would help hold slide 30.

FIG. 3 is similar to FIG. 2, except for the slide switch 30 has been moved to a second extreme position and internal moving components have changed their positions as will be described further below in connection with the description of the operation of flashlight 10.

Figure 4:
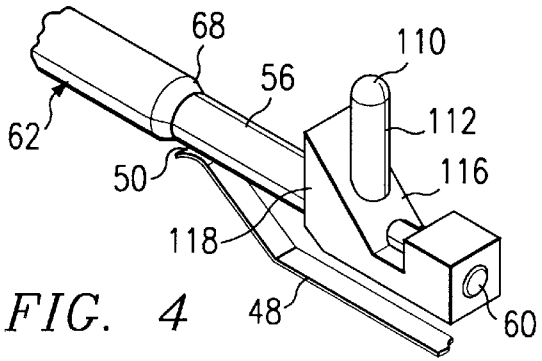
FIG. 4 is a perspective view of an internal portion of the flashlight of FIGS. 1–3.

FIG. 4 shows a perspective view of a portion of slide interface 118 and actuator link 112 of FIGS. 2 and 3. As described below, moving actuator 112 downward (for the orientation of FIG. 4) causes shaft 56 to move to the left (for the orientation of FIG. 4) as surfaces 114 and 116 slide against each other.

In operation, flashlight 10 allows an operator to hold flashlight 10 and turn it ON and focus it with a single hand. Referring to FIG. 2, flashlight 10 is shown in the first extreme position which is an ON, beam-focused position. In this position, switch 30 has been moved to its forwardmost position, i.e., the position of switch 30 nearest to first end 14. In this position, inner surface 106 of switch 30 has fully depressed first end 110 of actuator link 112 so that actuator 112 is almost flush with slide switch track 104 of body 12. As slide 30 moves from the second extreme position (FIG. 3) toward the first extreme position (FIG. 2) actuator link 112 moves into cavity 40 and first angled surface 114 slides down second angled surface 116 of slide interface 118. Because slide interface 118 is pushed against shoulder 120 of conductive shaft 56, it causes a lateral movement of shaft 56 longitudinally towards first end 14 and compresses spring 98. As shaft 56 moves towards first end 14, it causes lamp 24 to extend further into lamp-receiving aperture 88. The relative movement of lamp 24 with respect to reflector 90 changes the focus of flashlight 10 eventually going to a full-beam position (even beyond) when it is in this extreme position as shown in FIG. 2. As slide switch 30 is moved toward the rear of flashlight 10 or second end 18 (i.e., from position one toward position two), the angle of inner surface 106 will allow actuator link 112 to extend out of cavity 32. As this occurs, biasing, conductive spring 98 will force shaft 56, and movement of actuator link 112 will now allow, to move towards second end 18. As this occurs, lamp 24 is moved towards second end 18 through lamp-receiving aperture 88, thus moving the lamp 24 more and more towards a flood-focus position, which may exist in the second extreme position.

During the movement all the way between the first extreme position of FIG. 2 to the position shown in FIG. 3, power is continuously supplied to lamp 24 because first or curled end 50 of slide shoe 48 remains in electrical contact with shaft 56. Upon reaching the second extreme position, first end 50 of slide shoe 48 will be forced away from conductive shaft 56 by first shoulder 68 of conductive portion 64 of collar 62; because of the insulation on insulated portion 64, the lamp circuit is interrupted and flashlight 20 is in the OFF position.

Numerous alternatives may be included with flashlight 10. For example, slide 30 may be omitted and actuator link 112 positioned in and out of cavity 32 directly by the operator's hand or digit. Additionally, the embodiment shown has the lamp 24 moving relative to the fixed reflector 90, but in another embodiment, reflector 90 could move and lamp 24 could be fixed with respect to head 16.

Numerous other alternatives are possible, but although the present invention and its advantages have been described in detail, it should be understood that various changes, substitutions and modifications can be made without departing from the spirit and scope of the invention as defined by the following claims.

What is claimed is:

1. A flashlight comprising:

a body having a cavity therein, a first end and formed with an actuator-receiving aperture;

a head removably coupled to a first end of the body;

a reflector coupled to the head and formed with a lamp-receiving aperture;

a lamp;

a conductive shaft having a first end and a second end defining a shaft axis, the first end of the shaft electrically coupled to a positive contact on the lamp, the conductive shaft slidably disposed within the cavity;

a collar having an insulated portion and a conductive portion, the collar coupled to the first end of the conductive shaft with the insulated portion coupled to and extending a predetermined distance from the first end of the conductive shaft in the direction of the second end of the conductive shaft, the collar formed to have a lamp-receiving cavity for receiving and holding the lamp;

a slide interface having a first surface angled with respect to the shaft axis and coupled to the conductive shaft;

an actuator having a second surface angled with respect to the shaft axis to compliment the first surface, the actuator slidable within the actuator-receiving aperture on the body;

a biasing means disposed between a portion of the head and the collar for urging the conductive shaft away from the first end of the body;

whereby movement of the actuator in the actuator-receiving aperture causes the second surface of the actuator to slide with respect to the first surface of the slide interface to cause the lamp on the conductive shaft to move relative to the reflector to selectively focus the flashlight and whereby movement of the slide switch to an extreme portion terminates power to the lamp; and wherein the shaft has a first shoulder and wherein the slide interface is sized and positioned to rest against a portion of the first shoulder.

2. The flashlight of claim 1 further comprising a slide switch slidably coupled to an exterior portion of the body adjacent the actuator-receiving aperture, the slide switch having an internal surface angled with respect to the shaft axis for contacting the first end of the actuator.

3. The flashlight of claim 2 wherein the internal surface of the slide switch further comprises a plurality of detents for providing resistance to movement of the slide switch relative to the flashlight body.

4. The flashlight of claim 1 further wherein:

the biasing means comprises a conductive spring;

the lamp comprises a bulb, positive contact, and bulb jacket; and further comprising a slide shoe disposed within the cavity and disposed against the conductive shaft at a first end and coupled to a power supply at a second end.

5. The flashlight of claim 1 wherein the slide interface comprises a low-coefficient-of-friction plastic.

6. The flashlight of claim 1 further comprising an actuator housing disposed within the cavity of the flashlight body, the actuator housing for guiding the conductive shaft.

7. The flashlight of claim 1 wherein the body comprises aluminum.

8. A focusable flashlight comprising:

a container having an opening and having a flat end and a second end defining a container axis;

a lamp for producing light when energized, the lamp disposed with the container;

a reflector for reflecting light, the reflector disposed within the container;

an actuator disposed within the opening of the container and sized and configured to slide therein and having a first surface angled with respect to the container axis;

a moveable shaft disposed within the container;

a slide interface coupled to the shaft and having a second surface angled with respect to the container axis for sliding against the first angled surface of the actuator, the slide interface for urging the shaft in a first direction as the first surface of the actuator delivers a force to the second surface of the slide interface;

a power switch for selectively energizing the lamp;

a spring for urging the shaft in a second direction;

the lamp and reflector associated with the shaft whereby movement of the shaft causes relative movement of the lamp and the reflector to allow focusing of light from the lamp; and wherein the power switch comprises an insulated collar on the shaft, a slide shoe urged against the shaft, and the actuator.

9. The flashlight of claim 8, wherein the lamp is secured to a first end of the shaft and the reflector is secured to a portion of the container.

10. The flashlight of claim 8 wherein the power switch further comprises a slide switch slidably coupled to an exterior of the container.

11. The flashlight of claim 8, further comprising a slide switch slidably attached to an exterior portion of the container and having an internal surface angled with respect to the container axis for engaging a portion of the actuator.

12. The flashlight of claim 11, further comprising detents formed on the internal surface of the slide switch.

13. A flashlight comprising:

a body having a cavity therein with an actuator-receiving opening through a portion of the flashlight body;

a shaft disposed within the cavity of the flashlight body and moveable therein, the shaft having a first end and a second end defining a shaft axis;

an actuator link extending into the actuator-receiving opening, the actuator link sized to be slidable within the actuator-receiving opening, the actuator link having a first surface angled with respect to the shaft axis;

a slide interface coupled to the shaft and having a second surface angled with respect to the shaft axis for sliding against the first angled surface, the slide interface for urging the shaft in a first direction when the first angled surface delivers a force to the second surface;

a lamp disposed within the cavity and associated with the shaft;

the slide interface and actuator operable in combination to focus light from the lamp when an operator causes the actuator to move;

a switch means for selectively energizing the lamp; and wherein the switch means comprises:

an insulated collar surrounding a portion of the shaft;

a slide shoe coupled at a first end to a positive contact of a battery and impinging upon the shaft at a second end of the slide shoe; and a conductive spring disposed between the body and the lamp providing a negative contact to the lamp.

14. The flashlight of claim 13 wherein the flashlight comprises an exterior and further comprising a slide switch moveably disposed on the exterior of the flashlight for selectively moving the actuator.

15. The flashlight of claim 14 wherein the slide switch has an internal surface angled with respect to the shaft axis for moving the actuator and further comprising detents formed on the internal surface of the slide switch.

16. A focusable flashlight comprising:

a container having an opening and having a first end and a second end defining a container axis;

a lamp for producing light when energized, the lamp disposed within the container;

a reflector for reflecting light, the reflector disposed within the container;

an actuator disposed within the opening of the container and sized and configured to slide therein and having a first surface angled with respect to the container axis;

a moveable shaft disposed within the container;

a slide interface coupled to the shaft and having a second surface angled with respect to the container axis for sliding against the first surface of the actuator, the slide interface for urging the shaft in a first direction as the first surface of the actuator delivers a force to the second surface of the slide interface:

a power switch for selectively energizing the lamp;

a spring for urging the shaft in a second direction;

the lamp and reflector associated with the shaft whereby movement of the shaft causes relative movement of the lamp and the reflector to allow focusing of light from the lamp; and a fastener means for securing the slide interface to the shaft.

* * * * *